US006149329A

United States Patent [19]

Tuli

[11] Patent Number: 6,149,329

[45] Date of Patent: Nov. 21, 2000

[54] VERSATILE PRINTING MECHANISM

[75] Inventor: Raja Singh Tuli, Montreal, Canada

[73] Assignee: Raja Tuli, Montreal, Canada

[21] Appl. No.: 09/010,889

[22] Filed: Jan. 22, 1998

[51] Int. Cl.[7] ..... B41J 11/00

[52] U.S. Cl. ..... 400/634; 400/641; 400/642

[58] Field of Search ..... 400/636, 634, 400/641, 658, 120.01, 120.18, 642

[56] References Cited

U.S. PATENT DOCUMENTS

| | | | |
|---|---|---|---|
| 4,824,514 | 4/1989 | Schneider et al. | 156/387 |
| 5,425,586 | 6/1995 | Berson | 400/120.01 |

*Primary Examiner*—John S. Hilten

[57] ABSTRACT

A wide format versatile printing mechanism is provided which has ribbon tensioning means to equalize the surface tension forces across the ribbon and remove all wrinkles. In one embodiment a cambered rod is introduced between the print head and the ribbon feed roll to apply an uneven force across the ribbon's width from its uncoated side. The cambered rod is fixed between two lateral lid side plates by two screws having their axis coaxial with the axis of the cambered rod which have at one of the end cut some radial grooves. The cambered rod can be rotated around its axis and positioned under different angles around its axis by means of a set screw through the lid side plate which corresponds with the radial grooves of the cambered rod's end, offering a variation of the tensile forces in the ribbon. In another embodiment, a second rotating cambered rod is located between the print head and ribbon take-up roll to apply an uneven tensile force across the ribbon's width from its uncoated side. This provides an alternate and a versatile additional means for equalizing the tensile forces across the ribbon as it is transported within the device and adapting with different types of ribbon.

3 Claims, 12 Drawing Sheets

VERSATILE PRINTING MECHANISM

BACKGROUND OF THE INVENTION

The present invention relates to an apparatus and a method for producing uniform tension in a wide roll of waxed based ink ribbon during printing, to remove all wrinkles due to uneven surface tension across the ribbon. As ribbons increase in width they become more difficult to handle as a force must be applied across their width of varying magnitude to eliminate wrinkles. This is generally due to the nature of the polyester based carrier onto which the wax formula ink coating is uniformly applied. Unwinding of the ribbon for printing purposes onto a base paper requires this uneven force applied across the width, as the center has a tendency to sag and wrinkle under a uniform force applied across the width. Hence, a cambered circular or elliptical rod having a smooth surface is introduced acting against the ribbon to apply an uneven force, with an increment towards the center, counteracting the inherent sag in the ribbon as it is unwound. Wrinkled ribbons do not transfer ink onto the base paper at locations of these wrinkles, affecting the overall image quality.

Prior art in this field would involve thermal transfer printing mechanisms which use a waxed based ribbon to transfer an electronic image onto a base paper. A thermal print head is used as the heat source to melt the ribbon's ink coated on a carrier film, usually polyester, transferring ink to the base paper as selected heating elements comprising picture elements, or pixels, are individually addressed and heated to produce a tangible image on base paper.

The main problem associated with most prior art systems for this particular application is the narrow width of ribbon commonly found in most thermal transfer printing mechanisms. For printing widths of 8 ½ inches or less, the thermal transfer ribbon handles suitably without the need for any ribbon tensioning devices. As printing widths increase to 24 inches and greater, there is considerable sag in the center of the ribbon which leads to printing problems as the ribbon wrinkles, also impairing document handling.

An example of a conventional printing mechanism related to the prior art, is shown in FIG. 1*a* to 1*f* of the accompanying drawings, according to Sakuragi et al. in U.S. Pat. No. 4,910,602.

In this printing mechanism according to FIG. 1*a*, a ribbon ink 1 unwounded from a core 2 is superposed on a recording paper 3 wound on a core 4. The ribbon ink 1 is directed between a thermal head 5 and a platen roller 6 via a tension roller 7 and is taken-up by a take-up shaft 8.

The prevention of ribbon 1 wrinkling conforming to Sakuragi's patent is accomplished by the tension roller 7. According to FIG. 1*b*, the roller 7 can rotate around its axis, having a bulged portion at its center, and gradually tapers lengthwise in both directions from the center.

In this case, as shown in FIG. 1*c*, the roller 7 induces in the ribbon ink 1 some tensile forces F1. The shape of the tensile forces F1 is determined by the gradual increase and decrease of the roller 7 diameter which is manufactured in such a way that the tensile forces F1 cannot be changed during rotation of the roller 7, thus lacking the ability to adapt the tensioning profile to various ribbon's elasticity. This is a major drawback of Sakuragi's patent.

Similarly, in another embodiment of Sakuragi's patent according to FIG. 1*d*, he uses two fixed side walls 9 and 10 in front of and behind the print head 5, which induce in the ribbon ink 1 some tensile forces F2 as shown in FIG. 1*f*. The variation of tensile forces F2 is determined by the profile of the side walls 9 and 10.

As shown in FIG. 1*e*, he uses a shaped edge profile peaking in the center for his walls. This solution does not conform exactly to the distribution of tensile forces in ribbon foils of a variety of compositions, as the device has no ability to adapt to various ribbons.

Further, the inclination of the sided walls 9 and 10 against ribbon's 1 surface is fixed; this also lacks the ability to adapt to the tensioning profile of various ribbon's elasticity. In his case, using a preset distribution of said forces will not necessarily work for different ribbon types.

In other words, Sakuragi's solution does not allow the flexibility of choosing different types of ribbon materials, limiting the user to type that works well with his device.

Hence, the primary function of the present invention is in the adapting to a variety of wide format ribbons to avoid any sag related complications affecting the image quality, allowing the flexibility of choosing different types of ribbon materials conforming to variations in elasticity.

SUMMARY OF THE INVENTION

In a principle aspect of the present invention, a versatile printing mechanism using a cambered rod is provided as a waxed ribbon is unwound from a feed roll before printing on a base paper due to the applied rotational force of a drive roller, to counteract the uneven surface tension encountered in wide format thermal transfer ribbon rolls.

In a further aspect of the present invention, the cambered rod which is located between the print head and the ribbon feed roll applies an uneven force as it contacts the ribbon in unwinding, with a greater force applied to the center of the ribbon across its width where there is much less surface tension compared to the ends.

In a further aspect of the present invention, the cambered rod is an integral part of the thermal transfer mechanism providing a means for smooth document handling and wrinkle free printing, as ribbon is released from a feed roll and collected on a take-up roll after the printing process.

The cambered rod is cylindrical in shape, having a fixed radius of curvature throughout its entire length. The cambered rod also has an axis which passes through its both ends.

Furthermore, the cambered rod ends are cut in parallel planes and perpendicular to the axis of the cambered rod, one of the ends having cut some radial grooves. The cambered rod is fixed between two lateral lid side plates with two screws having their axis coaxial with the axis of the cambered rod.

Moreover, the cambered rod can be rotated around its axis and positioned under different angles by means of a set screw through the lid side plate locking into a radial groove of the cambered rod's end.

By rotation of the cambered rod around its axis, uneven tensile forces are applied across the ribbon's width decreasing or increasing proportional with rotation angle.

In another embodiment of the present invention, a second cambered rod is applied between the print head and ribbon take-up roll to apply an uneven tensile force across the ribbon's width from its uncoated side, allowing a greater displacement of ribbon towards the center of the roll applying the most force at this location, gradually decreasing towards the ends symmetrically about the center.

This provides a versatile alternate means for equalizing the tensile forces across the ribbon as it is transported within the device which adapts to the different types of ribbon, and acts in conjunction with the force applied by the ribbon take-up roll and the first cambered rod, to remove all wrinkles.

BRIEF DESCRIPTION OF DRAWINGS:

This invention maybe better understood and its numerous objects and advantages will become apparent to those skilled in the art by reference to the accompanying drawings as follows:

FIG. 1*a* illustrates a schematic view of a thermal transfer printing mechanism using a bulged tension roller, conforming to one embodiment.

FIG. 1*b* illustrates a front view of the bulged tension roller.

FIG. 1*c* illustrates the tensile forces distribution in the ribbon, conform to one embodiment.

FIG. 1*d* illustrates a schematic view of a thermal transfer printing mechanism using two fixed side walls, conforming to another embodiment.

FIG. 1*e* illustrates a front view of one side wall.

FIG. 1*f* illustrates the tensile forces distribution in the ribbon, conforming to another embodiment.

DETAILED DESCRIPTION OF PREFERRED EMBODIMENTS

Figure 1A:
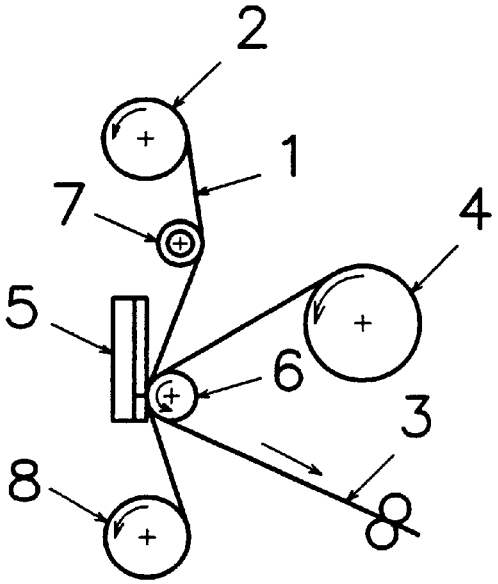
FIGS. 1*a* to 1*f* illustrates the prior art in accordance with Sakuragi's U.S. Pat. No. 4,910,602, as follows.
Figure 1B:
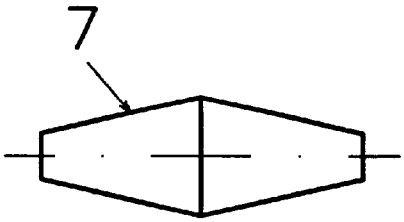
Figure 1C:
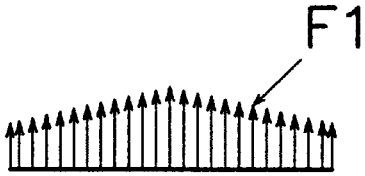
Figure 1D:
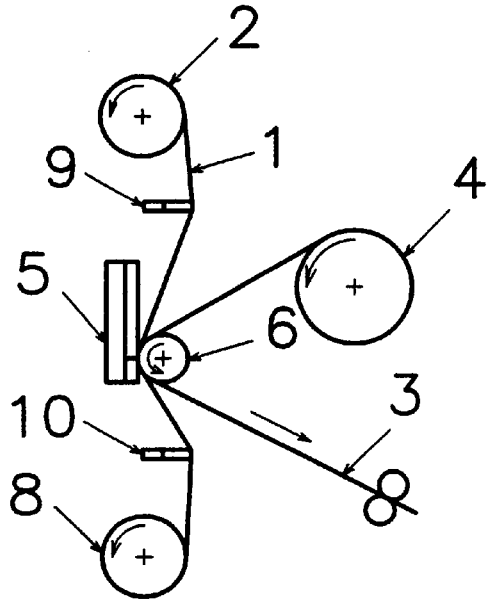
Figure 1E:
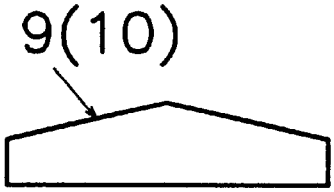
Figure 1F:
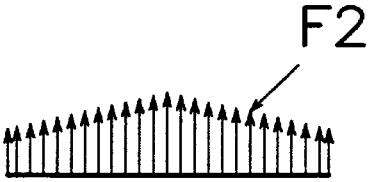
Figure 2:
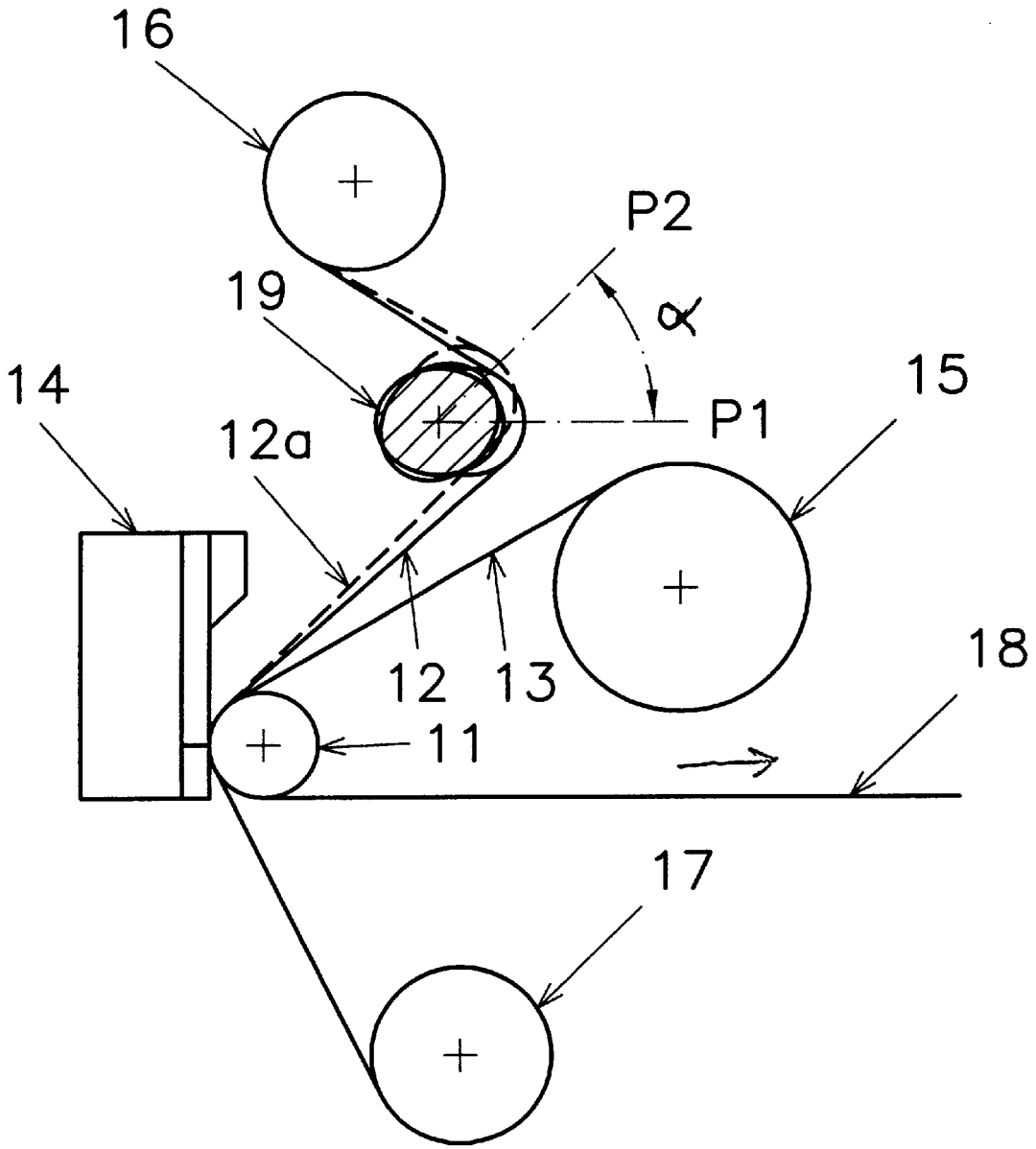
FIG. 2 illustrates a schematic side view of the versatile printing mechanism using a rotating cambered rod, in accordance with a first embodiment of the present invention.

For a better understanding of the invention's operation, reference is first made to FIG. 2, which represents a schematic side view of the versatile printing mechanism using a rotating cambered rod, in accordance with a first embodiment of the present invention.

Referring to FIG. 2, a drive roller 11 is used to transport an ink ribbon 12 and a base paper 13 simultaneously without any slippage as printing is performed by a thermal print head 14. The base paper 13 is stored in a roll 15 and is released at the same rate as the ribbon 12 from a feed roll 16. The ribbon 12 is constructed of a carrier material, usually polyester, coated with a wax and or resin formula uniformly on one first side of the ribbon, having an uncoated second side opposite to the first waxed side.

The thermal print head 14 applies heat at addressed locations along a print line to the uncoated side of the ribbon 12, which then releases the ink as it melts at individual heating element locations, representing each picture element or pixel of a printed image.

The melted ink is transferred from the ribbon 12 directly to the printing surface of the base paper 13 to form the printed image. After the printing process, the used ribbon is collected in a take-up spool 17 whilst the printed image appears on the output 18.

A cambered rod 19 is provided as the ribbon 12 is unwound from the feed roll 16 before printing on the base paper 13 due to the applied rotational force of the drive roller 11, to counteract the inherent uneven surface tension encountered in wide format thermal transfer ribbon rolls.

The ribbon's feed roll 16 is positioned to allow the ribbon 12 to flow over a cambered rod 19 which act s as a ribbon tensioner, prior to entering the thermal print head 14.

Figure 3:
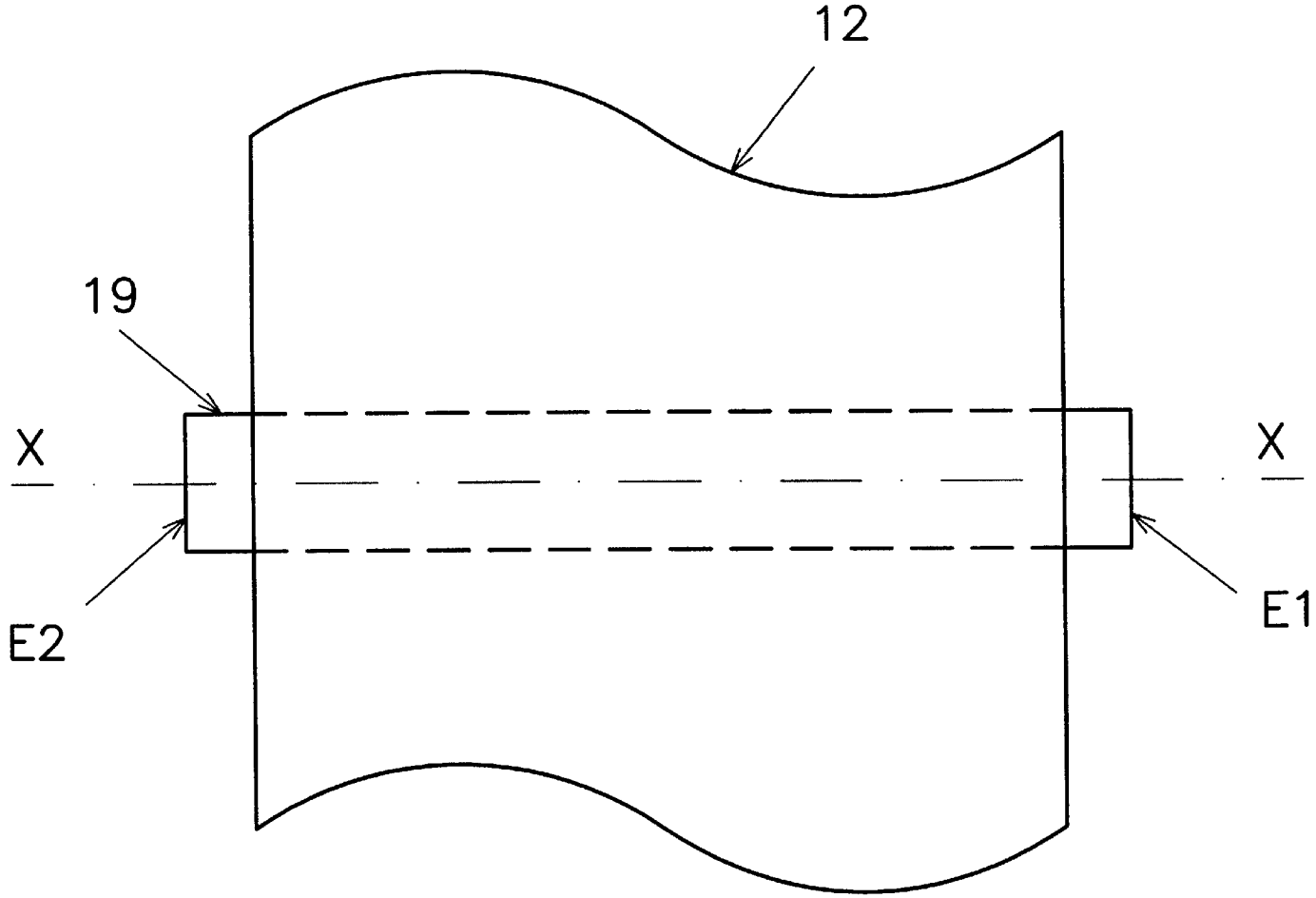
FIG. 3 illustrates a detailed frontal view of the versatile printing mechanism, respectively of the ribbon over the cambered rod which is in the first position, in accordance with the present invention.

The cambered rod 19 is cylindrical in shape having a fixed radius of curvature R through its entire length. The cambered rod also has an axis X-X which passes through its both ends (FIG. 3).

Figure 7:
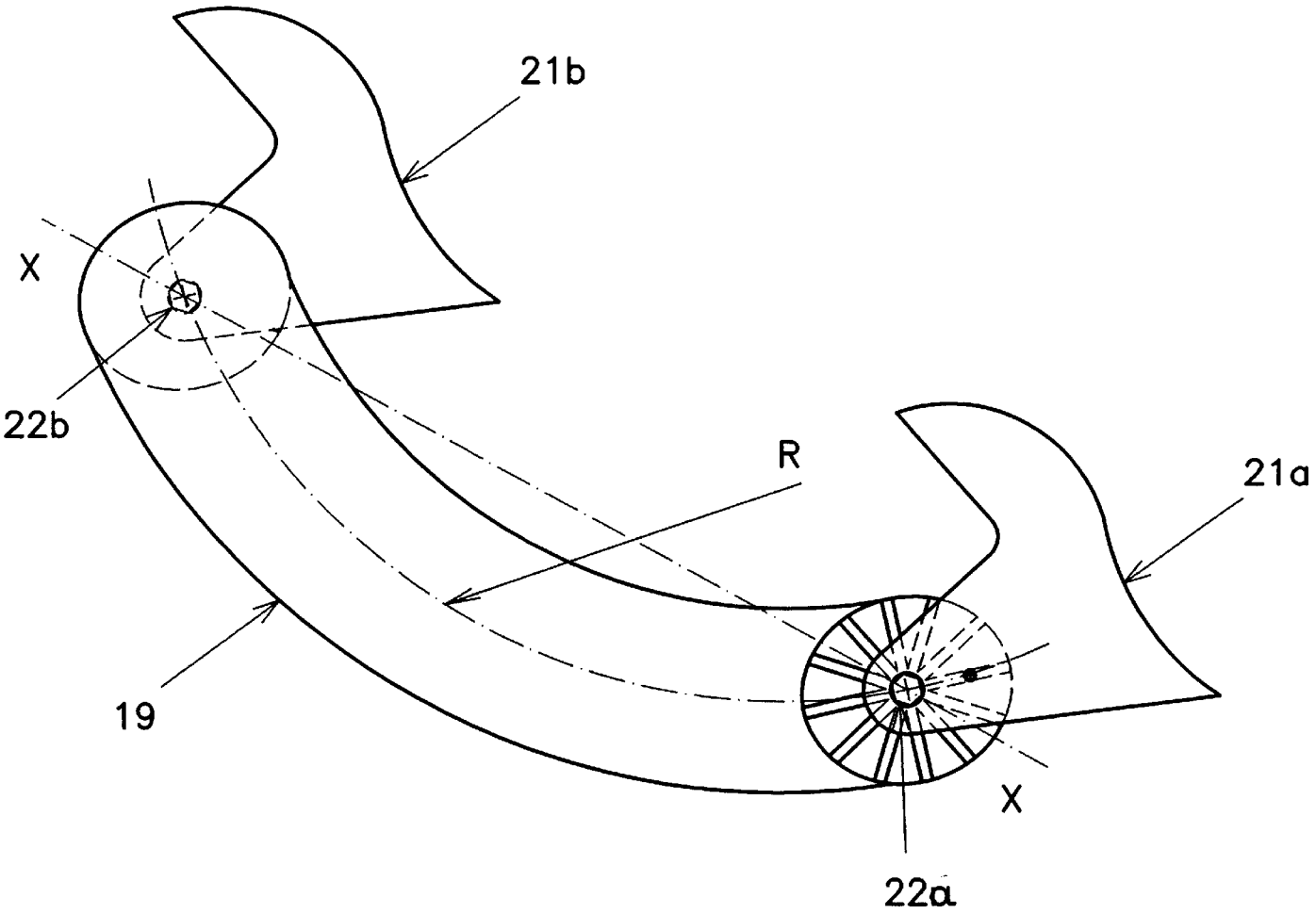
FIG. 7 illustrates a perspective view of the cambered rod assembled between a pair of lid side plates, in accordance with the present invention.

The cambered rod 19 has two ends E1 and E2 which are cut in parallel planes and perpendicular to the axis X-X of the cambered rod 19. One of the ends E2 has cut some radial grooves 20 (FIG. 7).

The cambered rod 19 is positioned with its axis X-X parallel to ribbon's 12 surface and fixed to a printing mechanism between two lid side plates 21*a* and 21*b* (FIG. 7), by means of some fixing screws 22*a* and 22*b* which passes through said lid side plates 21*a* and 21*b*. The axis of fixing screws 22*a* and 22*b* are coaxial with the axis X-X of the cambered rod 19.

Figure 2A:
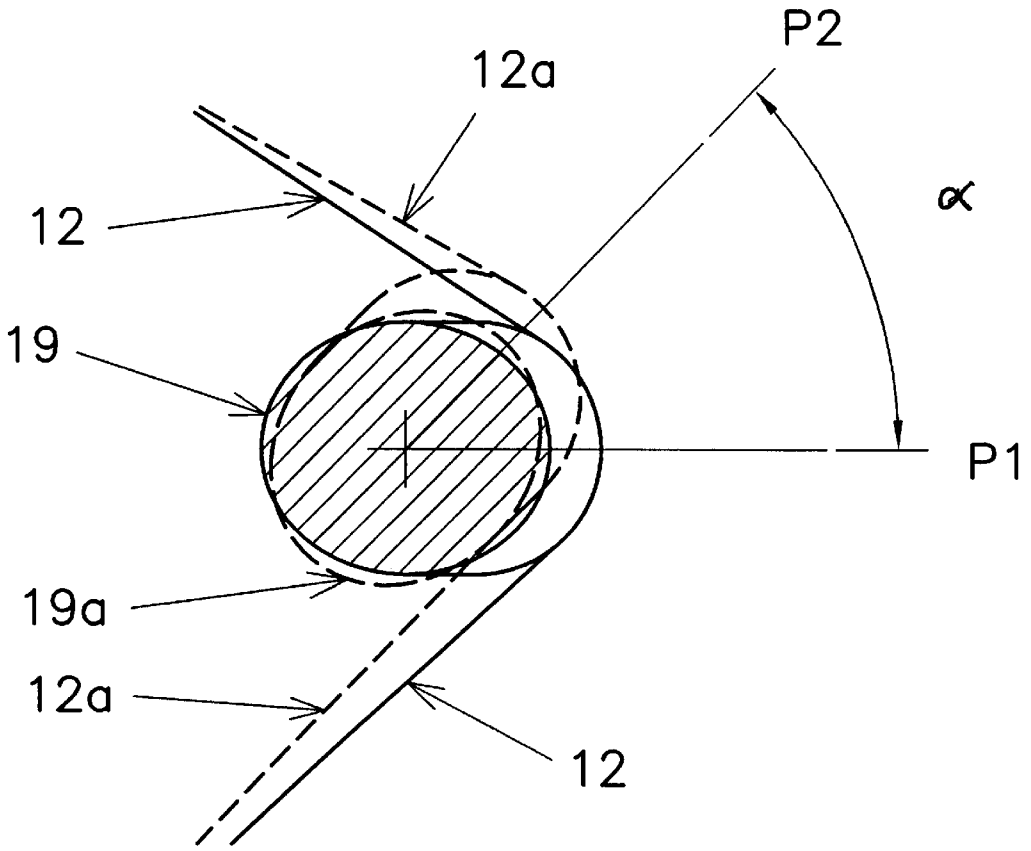
FIG. 2*a* illustrates an enlarged side view of the cambered rod in one first position and another second rotated position, in accordance with the first embodiment of the present invention.
Figure 8:
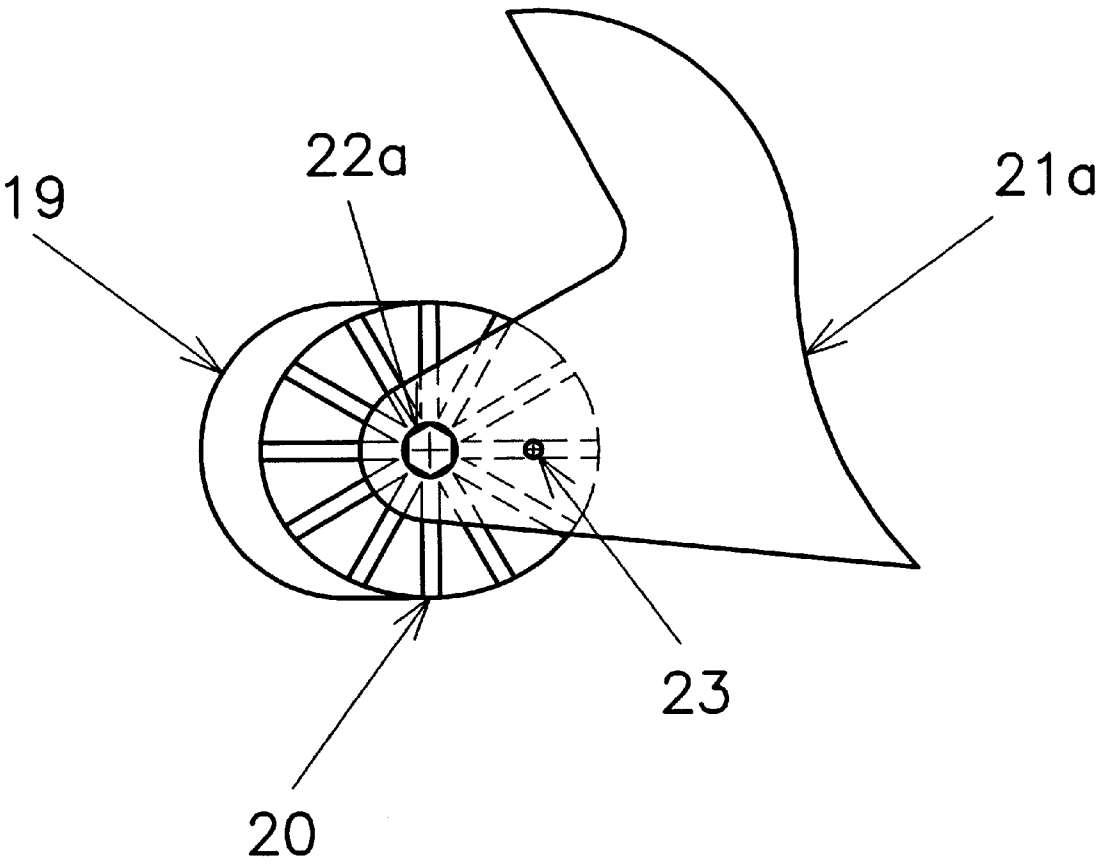
FIG. 8 illustrates a side view showing radial grooves at one end of the cambered rod and the lid side plate, in accordance with the present invention.
Figure 9:
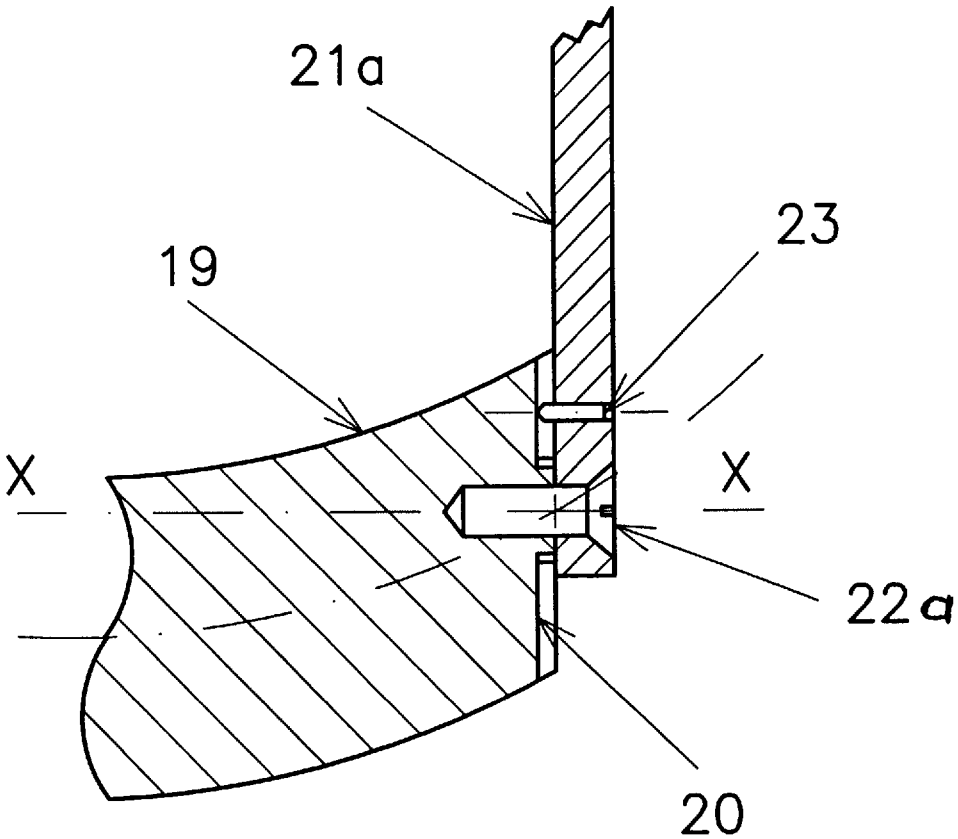
FIG. 9 illustrates a cross-sectional view at the grooved end of the cambered rod along its axis, in accordance with the present invention.

The cambered rod 19 can be rotated around its axis X-X, it can be also positioned from a first position P1 to a second position P2 (FIG. 2 and 2*a*) at a desired preset rotation angle $\alpha$ (FIG. 2 and FIG. 2*a*) by means of a set screw 23 through the lid side plate 21*a*. The set screw 23 is positioned to fit with the radial grooves 20 at the end of the cambered rod 19 (FIG. 7, 8 and 9).

As the cambered rod 19 rotates from its first position P1 to the second position P2 (FIG. 2*a*) representing a new profile 19*a*, the ribbon 12 changes its position to a new position 12*a*.

Figure 4:
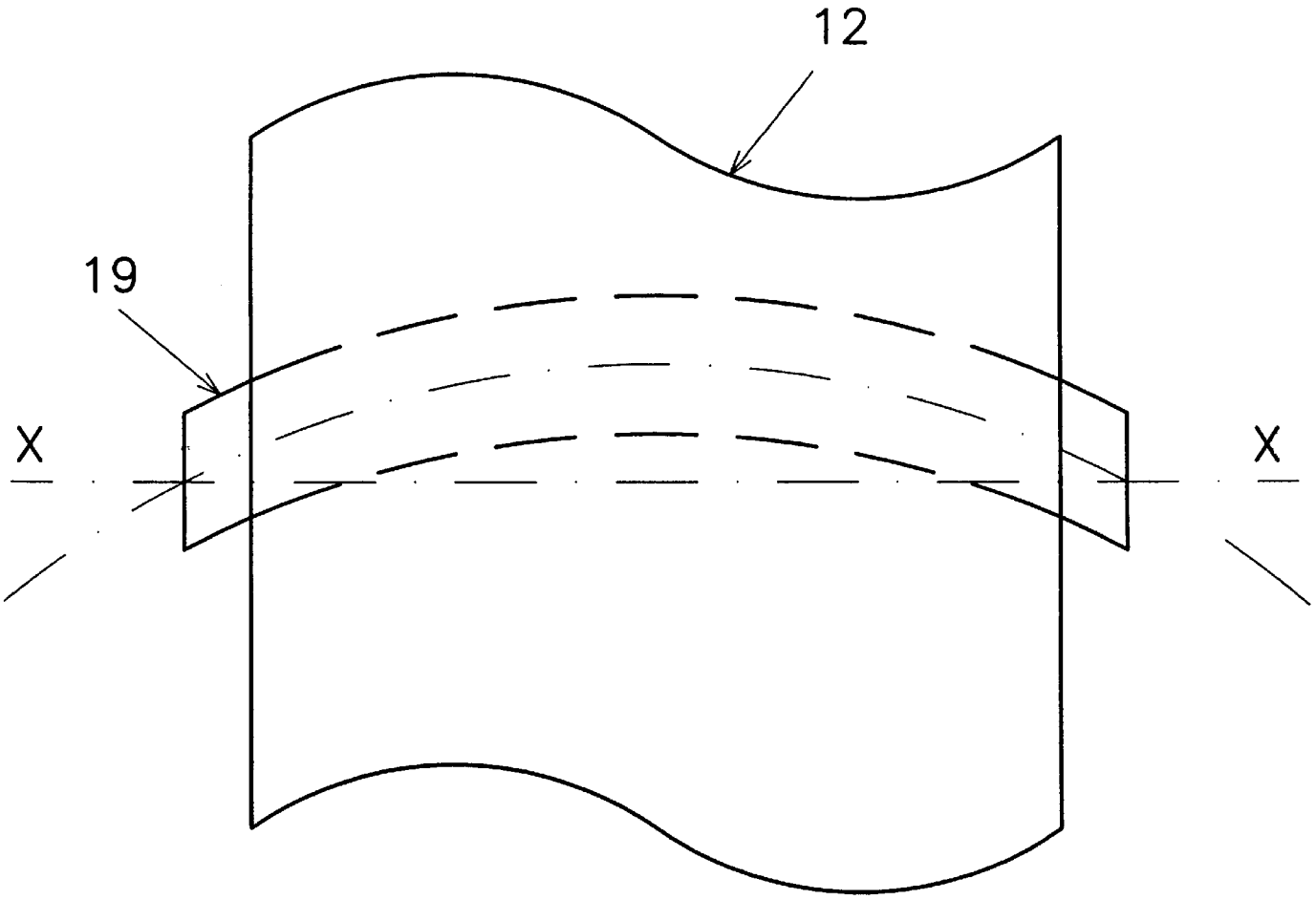
FIG. 4 illustrates a detailed frontal view of the versatile printing mechanism, respectively of the ribbon over the cambered rod which is in the second rotated position, in accordance with the present invention.
Figure 5:
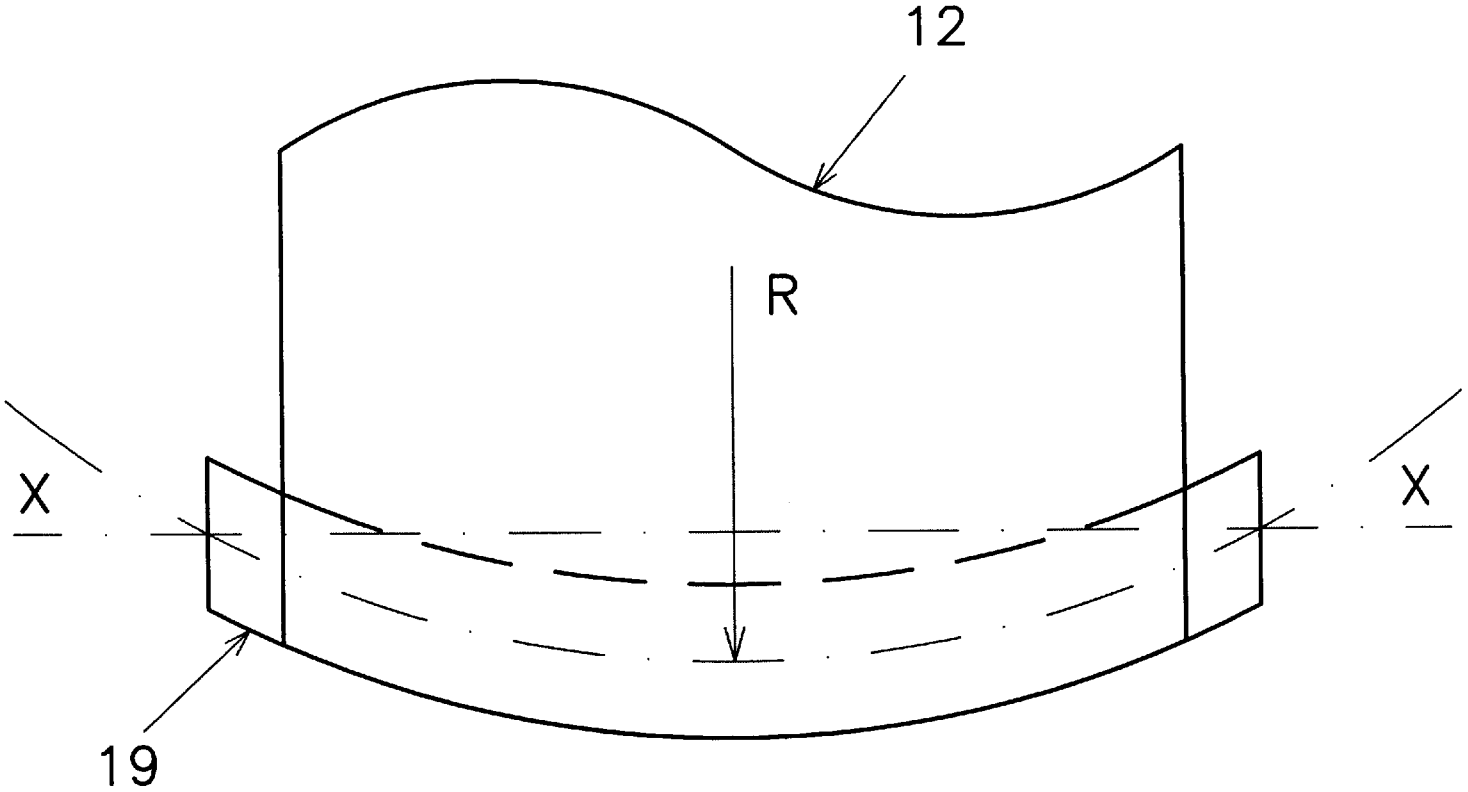
FIG. 5 illustrates a detailed top view of the versatile printing mechanism, respectively of the ribbon over the cambered rod which is in the first position, in accordance with the present invention.
Figure 6:
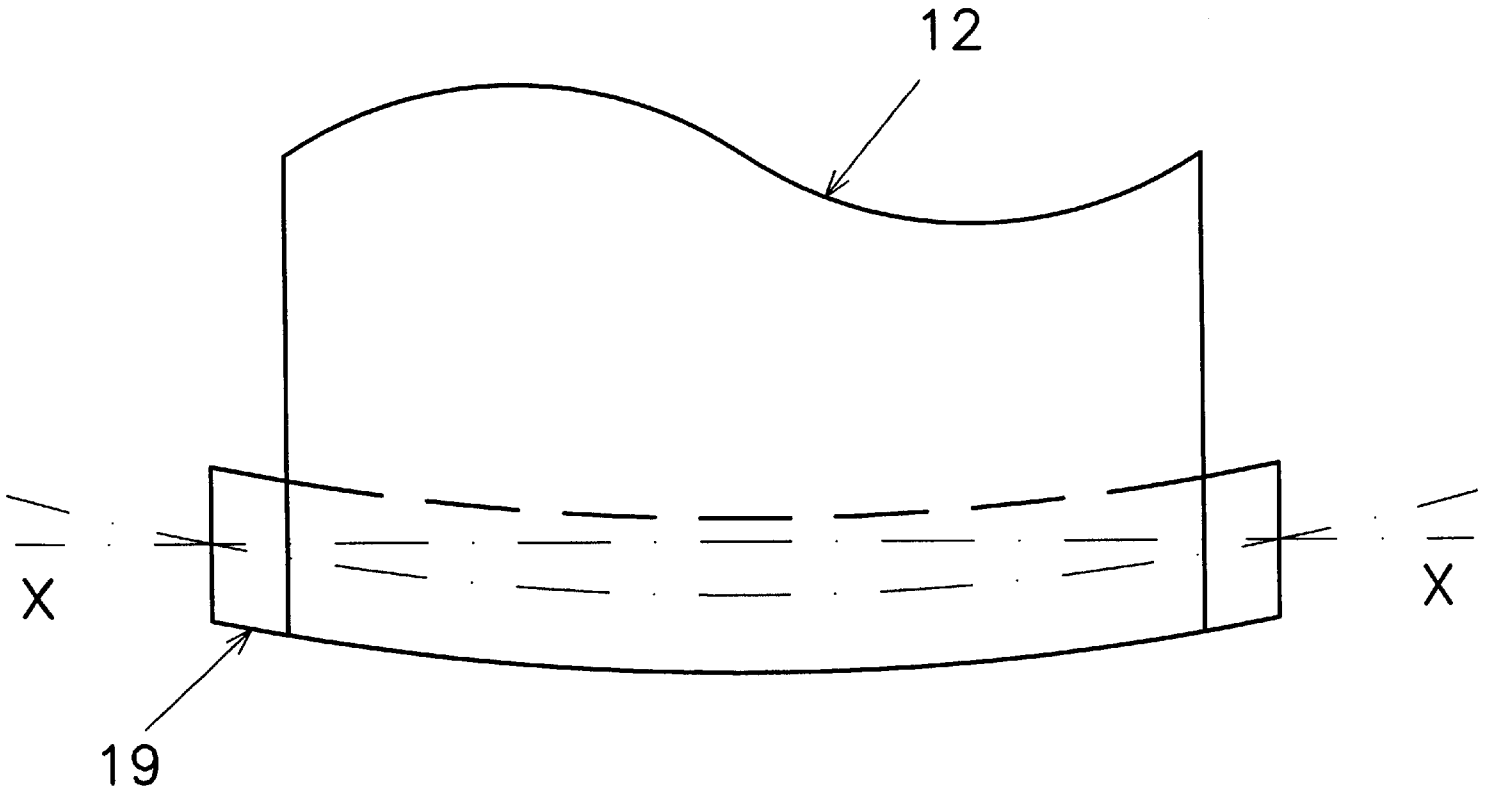
FIG. 6 illustrates a detailed top view of the versatile printing mechanism, respectively of the ribbon over the cambered rod which is in the second rotated position, in accordance with the present invention.

Corresponding to this rotation of the cambered rod 19, the ribbon's 12 profile of the first position P1 represented in FIG. 3 and FIG. 5 changes to a new profile of the second position P2 represented in FIG. 4 and FIG. 6.

Figure 10A:
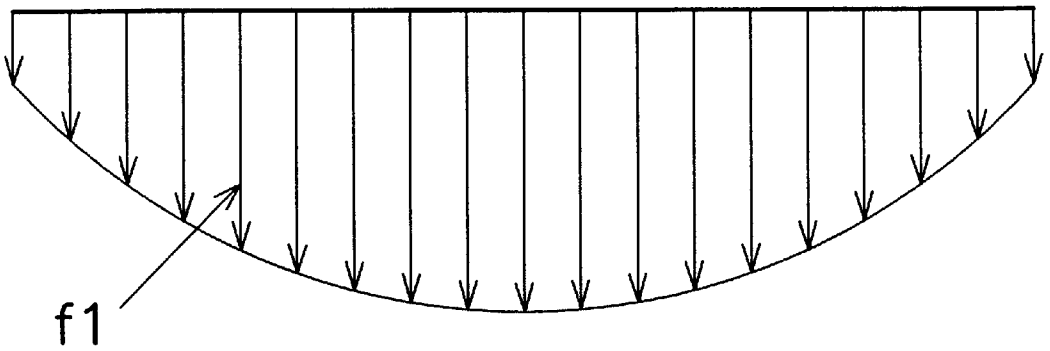
FIG. 10*a* and 10*b* illustrates the variation of the tensile forces f1 to f2 across the ribbon's width, corresponding with the first position P1 respectively second rotated position P2 of the cambered rod, in accordance with the present invention.

As presented in FIG. 10*a* corresponding to FIG. 5, the cambered rod 19 applies over the ribbon 19 width an uneven forces f1, allowing a greater displacement towards the center of the ribbon where the greatest sag occurs.

Figure 10B:
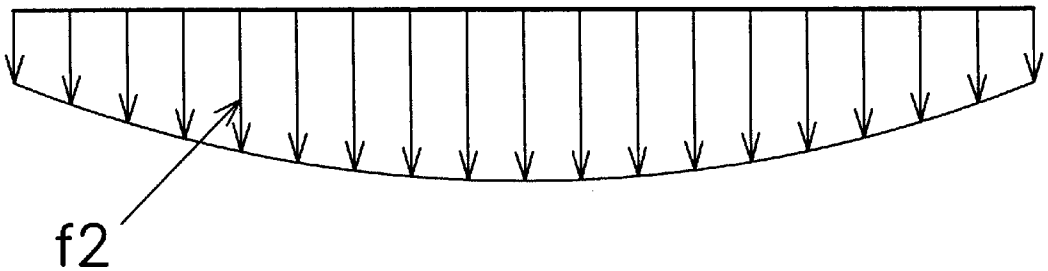

As presented in FIG. 10*b* corresponding to FIG. 6, as the cambered rod 19 rotates from its first position P1 to the second position P2 (FIG. 2*a*), a different tensile forces f2, reduced in amplitude in this case, is induced across the width of the ribbon 12, better adapting with different types of ribbon.

The variation of the tensile forces induced by the cambered rod 19 across the ribbon's 12 width, from f1 to f2 presents a different amplitude shape which is in this case less bulged corresponding to second position P2 of the cambered rod 19 (FIG. 10*b*).

Figure 11:
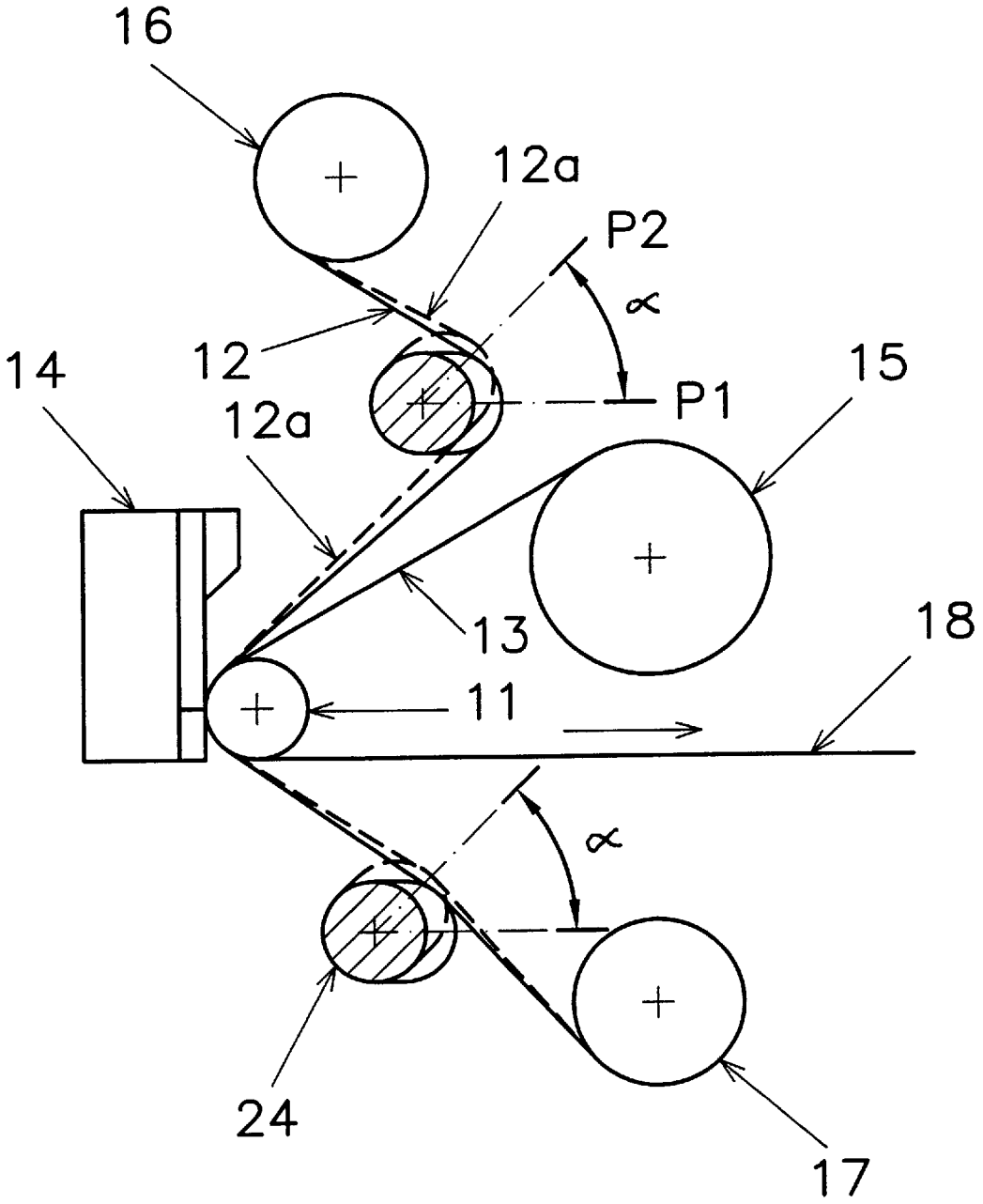
FIG. 11 illustrates a schematic side view of the versatile printing mechanism in accordance with another embodiment of the present invention whereby a second rotating cambered rod is located between the print head and ribbon take-up roll, in accordance with the present invention.

In another embodiment of the present invention conforming to FIG. 11, a second cambered rod 24 is applied between the print head 14 and ribbon take-up roll 17 to apply an uneven tensile force across the ribbon's 12 width from its uncoated side.

This provide an alternate and a versatile additional means for equalizing the tensile forces across the ribbon, acting in conjunction with the force applied by the ribbon take-up roll and the first cambered rod to remove all wrinkles.

It is also understood that the following claims are intended to cover all of the general and specific features of the invention herein described, and all statements of the scope of the invention which, as a matter of language, might be said to fall therebetween.

I claim:

1. A thermal transfer versatile printing mechanism designed to print in a wide format wherein:

a thermal transfer ribbon roll stored in a feed roll uniformly coated on a first side, is released (at the same rate as) and a base paper is released from a separate roll;

a thermal print head and a drive roller are positioned for the drive roller to apply pressure against a linear array of heating elements on the print head, with said thermal transfer ribbon and base paper sandwiched between said printhead and drive roller, whereby a rotational force applied by the drive roller moves the thermal transfer ribbon and base paper simultaneously;

a cambered rod, cylindrical in shape, having a support structure rotating said cambered rod through a fixed angle, having a fixed radius of curvature through its entire length is located between the print head and the ribbon feed roll;

the cambered rod applies an uneven force across the ribbon's width from its second side, allowing a greater displacement of ribbon towards the center of the roll applying the most force at this location, gradually decreasing towards the ends symmetrically about the center;

the cambered rod has an axis passing through the centers of its both ends, whereby said axis is parallel to the ribbon surface;

the cambered rod can be rotated around the axis and positioned under different angles around its axis;

by rotation of the cambered rod, via the support structure, around its axis an uneven tensile force across the ribbon's width varies in amplitude decreasing or increasing proportional with the rotation angle of said cambered rod;

the distribution of tensile forces induced by the cambered rod across the ribbon's width varies corresponding to different rotated positions of the cambered rod.

2. A device according to claim 1, wherein the cambered rod ends are cut in two parallel planes which are perpendicular to the axis of the cambered rod.

3. A device according to claim 1 and 2, wherein a second rotating cambered rod is located between the print head and ribbon take-up roll to apply an uneven tensile force across the ribbon's width from its uncoated side, allowing a greater displacement of ribbon towards the center of the roll applying the most force at this location, gradually decreasing towards the ends symmetrically about the center, providing a versatile alternate means for equalizing the tensile forces across the ribbon as it is transported within the device which adapts to the different types of ribbon.

* * * * *